United States Patent [19]

Lapadura

[11] 4,431,194

[45] Feb. 14, 1984

[54] IMPROVED BACKGAMMON AND DICE

[76] Inventor: Philip J. Lapadura, 6801 NW 8th St., Margate, Fla. 33063

[21] Appl. No.: 317,271

[22] Filed: Nov. 2, 1981

[51] Int. Cl.[3] ..... A63F 3/00; A63F 9/04

[52] U.S. Cl. ..... 273/248; 273/146

[58] Field of Search ..... 273/248–253, 273/146

[56] References Cited

U.S. PATENT DOCUMENTS

| | | | |
|---|---|---|---|
| D. 60,575 | 3/1922 | Saart | 273/146 X |
| 882,945 | 3/1908 | Hurst | 273/146 |
| 1,628,073 | 5/1927 | Sousa | 273/146 X |
| 4,092,029 | 5/1978 | Jones | 273/146 X |
| 4,114,290 | 9/1978 | Cooper | 273/146 X |

FOREIGN PATENT DOCUMENTS

| | | | |
|---|---|---|---|
| 515816 | 12/1939 | United Kingdom | 273/248 |
| 2008956 | 6/1979 | United Kingdom | 273/146 |

OTHER PUBLICATIONS

H. J. R. Murray *A History of Board-Games Other Than Chess* c 1952 pp. 117–129.

*Primary Examiner*—Richard C. Pinkham
*Assistant Examiner*—Scott L. Brown
*Attorney, Agent, or Firm*—Malin & Haley

[57] ABSTRACT

A game for two players including a new and improved set of three dice, a backgammon board and thirty chips or men, fifteen of one color or mark and the other fifteen of another color or mark. The three dice include two dice with conventional digits and a third die with conventional digits and positive and negative symbols adapted to be used by competing players for designating movements around the gaming board.

4 Claims, 18 Drawing Figures

IMPROVED BACKGAMMON AND DICE

BACKGROUND OF THE INVENTION

Games using gaming boards have been used for thousands of years. The oldest known source of backgammon dates back some five thousand years; however, it is believed that the present form of the game evolved in the tenth century. In 1743, the famous Edmund Hoyle codified the rules and strategy. The only change recorded has been the addition of the doubling die, which added to the challenge of the game.

In this improved game, the doubling cube is no longer used. The rules and dice have been improved to make the game more exciting and challenging, as there are now many ways to make moves, forward or backward.

BRIEF DESCRIPTION OF THE INVENTION

This invention relates to strategy and amusement devices and more particularly to a unique set of playing pieces which includes a game board, thirty chips and three dice, two of which have the digits one through six thereon and one of which has the digits one through six and positive and negative symbols thereon. The dice are adapted to be used by competing players for designating movements around the gaming board.

The apparatus provided by this invention challenges the skill and mental processes of persons encompassing a wide range of ages including adults and children having knowledge of basic arithmetic. Although this game can be used by children it is equally effective in challenging the skill and mental agility of adults possessing a wide range of educational attainment.

The components comprising the apparatus include a gaming board divided into four parts with each player having both an "inner table" and an "outer table". In addition to the gaming board the apparatus includes three dice of which one pair is a standard set of dice with six faces having indicia by dots relating to the number rolled. The third die includes the same dot numbering indicia and additionally carries a plus or minus sign, thus allowing for a wider range of values due to the ability to roll negative numbers for negative movements.

The primary object of the present invention is to provide a new game using the existing backgammon board, a standard set of dice and a new die which replaces the doubling die used in the existing game of backgammon and which enables the competitors to play an entirely different game due to the ability to move backward in addition to forward.

In accordance with this and other objects which will be apparent hereinafter, the instant invention will now be described with particular reference to the accompanying drawings.

DESCRIPTION OF THE PREFERRED EMBODIMENT

Figure 1:
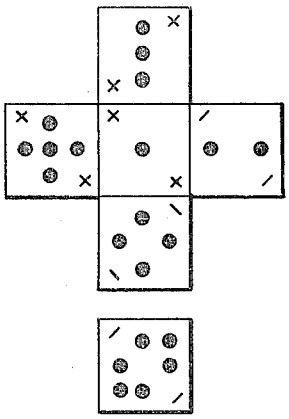
FIG. 1 shows the markings on all six sides of the new and improved die cube.
Figure 2:
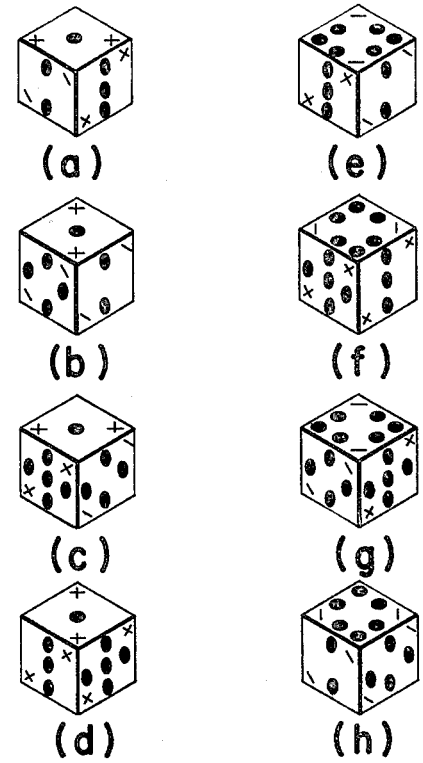
FIGS. 2 (*a* through *h*) are isometric views of the new and improved die cube.

This invention is to a game and game method for two players using a backgammon board, thirty chips or men, a pair of dice that may be of a new design, and a special die as shown in FIGS. 1 and 2. The special die has the symbols plus (+) and Minus (−) on it to provide for both positive and negative moves. The game may also include two dice boxes.

Figure 3:
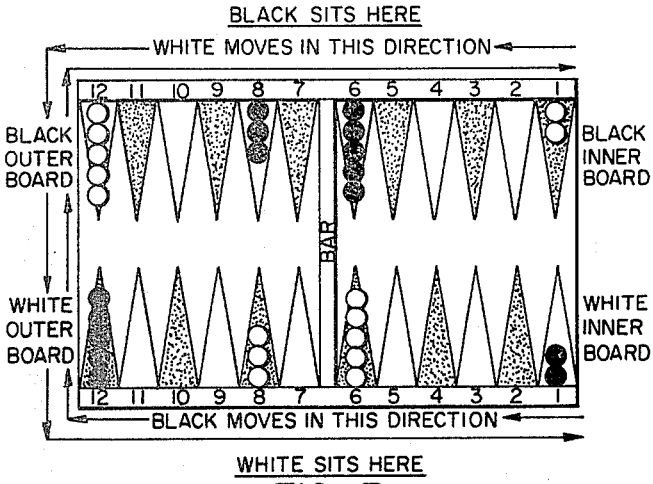
FIG. 3 is a plan view of the initial game setup.
Figure 4:
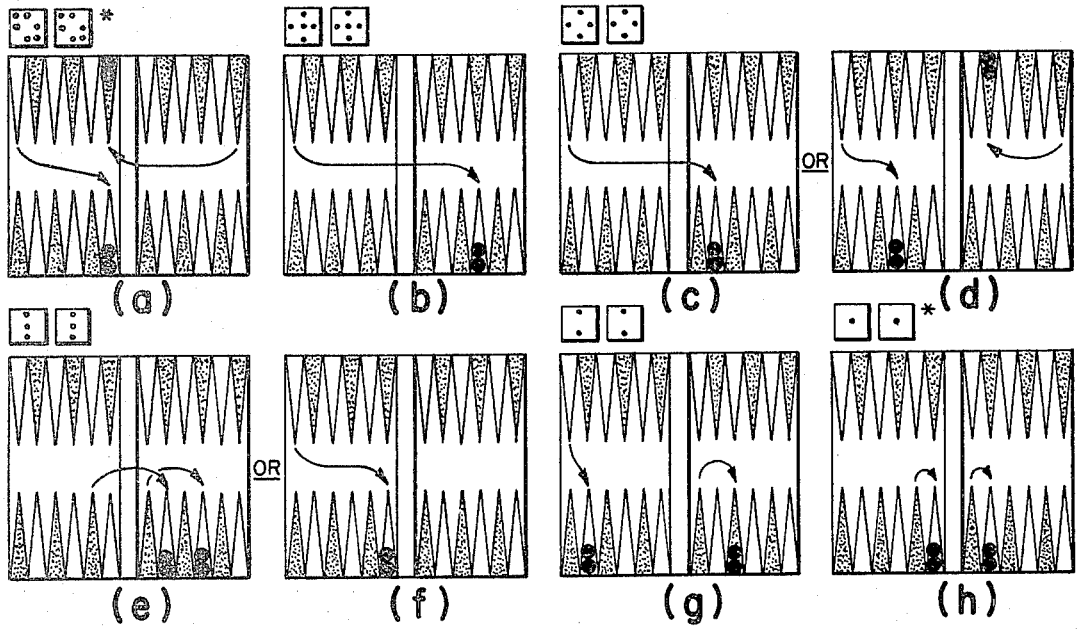
FIGS. 4 (*a* through *h*) show the preferred first moves when doubles are rolled.

Referring now to FIG. 3 showing the set-up of the game board, the proper position of the men for the start of the play is illustrated. The diagram shows the direction of movement of both the dark and light colored men. The game board as shown in FIG. 3 is divided into four parts with each player having both an "inner table" and an "outer table". Each table is divided into six "points" with alternate colors, three each. Note also that the points of opposing tables are of contrasting colors.

The object of the game is for each player to move his men according to the numbers shown on the throw of three dice. He moves his men from his opponent's inner table along the playing board, across to his outer table, and finally into his own inner table. The dark and light pieces move in opposite directions, as shown on diagram. The bar is the middle strip that separates the inner and outer tables. Once one of your men has been placed on the bar, you must throw the dice when your turn occurs and you must "enter" into your opponent's inner table. Entering is accomplished by moving the man on the bar to the point indicated on either one of the dice thrown, as long as that point is not blocked. If you cannot enter because the points are blocked, the turn then passes to your opponent. A shutout or closed board occurs when your opponent's inner table is completely closed. (Each point covered by at least two men). A blot is any point on which a player has only one man. When an opponent lands on a blot, he removes the man that was there and replaces it with his own. This is called a "hit". The man removed is placed on the bar.

Doublets may be rolled. Doublets means rolling doubles, i.e. the same numbers thrown on both regular dice. In backgammon when this occurs, that player moves the number shown on one die four times. The same man may be moved all four moves or in any other combination. When doubles are thrown and the third die is the same number, doubles rule is in effect and the third die allows a fifth forward move of the number shown on this die, i.e., five forward moves. For example: 5 and 5 and 5 = four moves of five of any of the chips and then five more moves forward.

When player throws doubles on the regular dice and the special die is minus (−) the same number, doubles are cancelled and the sum of one die only is moved forward. When numbers must be subtracted and men are moved backwards, the backward moving man can "hit" or remove opponent's man from play to be placed on the bar. If the doubles sum total are less than minus (−) number on the special die, moves are then made backwards. If no space is available, one man must be removed from play and placed on the bar.

Another doubles rule that may be used in the game is that, when doubles are numbers less than the minus (−) number on the special die, there are no moves and opponent takes the board for his throw. This rule must be agreed to when the game is started.

The laws of Backgammon say that each player throws one die in order to determine who goes first. If both players roll the same number, they must throw again until one player has rolled the highest number. That player then goes first, using the numbers shown on the two dice, his own and his opponent's. The players then throw in turn using their own dice. A player moves his men according to the numbers shown on the three dice. Cocked dice means that one of the dice has not landed completely flat on the playing surface. When this happens, the player must throw again. The numbers shown on the dice are considered individually and not in sum total. Thus a player may move one man the whole throw as long as the points designated by each die are open, or he may move each of the three numbers with different men. This rule applies when all numbers are positive or plus members. A player must use all numbers of each die whenever possible. The special die also allows backward moves where possible. If the player cannot move at all, play passes to his opponent.

The new and improved game and method uses three dice of new design. The third special die has numbers and a plus (+) or minus (−) sign imprinted on it. The pair of playing dice have the same number arrangements as the special die but do not have the plus (+) or (−) symbols on them as shown in FIG. 1. This special die determines the additional forward or backward moves to be made by the player. When the sum of the three dice are all plus (+), the three moves are made forward by the numbers on each die. When minus (−) numbers on the special die are less than or equal to the numbers on one of the regular dice, subtract from that die number only.

For example:

6 and 4−3=6+1 or 6 moves and 1 move forward.
6 and 4−4=6 forward moves only.
5 and 2−1=5 moves and 1 move forward.

FIGS. *4a, 4b, 4c, 4d, 4e, 4f, 4g* and *4h* show the best opening moves when you throw doubles. The ones marked by an asterisk are the best opening moves, and should cause a double offer immediately if your opponent has a poor start. Find the best position for the fifth move.

A blocked point is any point on the playing board on which two or more men of the same play sit. The opposing player's men can not land on a blocked point, however, they can move over the blocked point. There is no limit to the number of men one player may have on a point.

Bearing off means removing your men from the playing board by the roll of the dice. Bearing off cannot start until all 15 of a player's men are in his inner table. That player may then either bear off men from points corresponding to dice thrown or he may move his men within his inner table according to the numbers shown on the dice. If while bearing off, a man in the bearing-off player's inner table is "hit", that man goes onto the bar and must re-enter as described earlier. Bearing off cannot continue until this man, who was "hit", gets back into that player's inner table.

A game is won when either player bears off all of his men first. A gammon (double game) is won if the opponent has not borne off any of his men. A backgammon (triple game) is won if the opponent has not borne off any of his men and has one or more men in the winner's inner table or on the bar.

Points can be given for winning games. Winning a single game is worth a hundred (100) points. A gammon is worth 200 points. A backgammon or triple game is worth 300 points. The winner of a set is the player who has earned a total of 500 points. Players of this new improved game will see many other combinations appear on the throw of three dice. It is advised that players do not make up too many new rules as the game will then become complicated.

The instant invention has been shown and described herein in what is considered to be the most practical and preferred embodiment. It is recognized, however, that departures may be made therefrom within the scope of the invention and that modifications may occur to a person skilled in the art.

What is claimed is:

1. An improved game of backgammon for two players comprising:

a backgammon board;

three cube-shaped dice each having six faces;

two said dice being identical and having dots representing digits one through six thereon, one digit per face;

said third die having dots representing digits one through six thereon, one digit per face, three said faces including positive symbols thereon, and three other said faces including negative symbols thereon.

2. An improved game of backgammon as recited in claim 1 wherein:

said three positive symbols included on three said faces of said third die appear in conjunction with the digits one, three and five; and said three negative symbols included on three other said faces of said third die appear in conjunction with the digits two, four and six.

3. A set of dice for use with an improved version of the game of backgammon, said set of dice comprising;

an identical pair of dice having six faces, each said face having dots representing one of six digits one through six thereon; and a third die having six faces each said face having dots representing one of six digits one through six thereon, three said faces including positive symbols thereon and three other said faces including negative symbols thereon.

4. A set of dice as recited in claim 3, wherein:

said three positive symbols included on three said faces of said third die appear in conjunction with the digits one, three and five; and said three negative symbols included on three other said faces of said third die appear in conjunction with the digits two, four and six.

* * * * *